US008235381B2

(12) United States Patent
Nireki

(10) Patent No.: US 8,235,381 B2
(45) Date of Patent: Aug. 7, 2012

(54) DEVICE FOR PROCESSING PAPER SHEETS OR THE LIKE

(75) Inventor: Takao Nireki, Tokyo (JP)

(73) Assignee: Universal Entertainment Corporation, Ariake, Koto-Ku, Tokyo (JP)

( * ) Notice: Subject to any disclaimer, the term of this patent is extended or adjusted under 35 U.S.C. 154(b) by 0 days.

(21) Appl. No.: 12/864,414

(22) PCT Filed: Jan. 23, 2009

(86) PCT No.: PCT/JP2009/051128

§ 371 (c)(1),
(2), (4) Date: Jul. 23, 2010

(87) PCT Pub. No.: WO2009/093716

PCT Pub. Date: Jul. 30, 2009

(65) Prior Publication Data

US 2010/0289212 A1 Nov. 18, 2010

(30) Foreign Application Priority Data

Jan. 25, 2008 (JP) ..... 2008-015305

(51) Int. Cl.
*B65H 85/00* (2006.01)
*B65H 1/00* (2006.01)

(52) U.S. Cl. ..... 271/171; 271/3.14

(58) Field of Classification Search ..... 194/344, 194/350, 351; 271/3.01, 3.14, 171
See application file for complete search history.

(56) References Cited

U.S. PATENT DOCUMENTS

| | | | | |
|---|---|---|---|---|
| 5,494,144 | A * | 2/1996 | Izawa | 194/203 |
| 7,370,860 | B2 * | 5/2008 | James et al. | 271/171 |
| 7,429,039 | B2 * | 9/2008 | Hattori et al. | 271/10.01 |
| 7,604,228 | B2 * | 10/2009 | Ohama et al. | 271/3.14 |
| 7,703,593 | B2 * | 4/2010 | Kim | 194/351 |
| 7,832,726 | B2 * | 11/2010 | Osakabe | 271/261 |
| 2003/0047860 | A1 * | 3/2003 | Takamatsu | 271/3.14 |
| 2003/0151188 | A1 * | 8/2003 | Imahara | 271/171 |
| 2006/0071388 | A1 * | 4/2006 | Okuda et al. | 271/8.1 |
| 2006/0085946 | A1 * | 4/2006 | Hattori et al. | 16/221 |
| 2006/0255532 | A1 * | 11/2006 | Tsai | 271/171 |
| 2008/0048389 | A1 * | 2/2008 | Shimazu et al. | 271/253 |

FOREIGN PATENT DOCUMENTS

| | | |
|---|---|---|
| JP | 60 57870 | 4/1985 |
| JP | 63 89181 | 6/1988 |
| JP | 7 20667 | 4/1995 |

* cited by examiner

*Primary Examiner* — Kaitlin Joerger

*Assistant Examiner* — Patrick Cicchino

(74) *Attorney, Agent, or Firm* — Lexyoume IP Meister, PLLC

(57) ABSTRACT

A paper sheet processing apparatus allowing easy insertion of a paper sheet such as a bill into an insertion slot is provided, although it is difficult to push the paper sheet for insertion because it is easily bent. The bill processing apparatus according to the present invention includes: an open/close member to be opened and closed with respect to a frame; a bill insertion slot formed such that a bill is capable of being inserted therebetween when the open/close member is closed with respect to the frame; a frame member mounted to the bill insertion opening and having a vertical frame piece along a thickness direction of the bill insertion slot and a horizontal frame piece along a lateral direction formed integrally with each other.

4 Claims, 13 Drawing Sheets

DEVICE FOR PROCESSING PAPER SHEETS OR THE LIKE

FIELD OF THE INVENTION

The present invention relates to a paper sheet processing apparatus (or device for processing paper sheets or the like) which processes a bill, a card, a coupon ticket, and so on (hereafter collectively referred to as "paper sheet" or "paper sheet or the like") having been inserted into an insertion slot.

BACKGROUND ART

In general, a bill processing apparatus, which is one of the embodiments of the paper sheet apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid. Such a bill processing apparatus includes a bill insertion slot into which the bill is inserted, a bill conveyance mechanism which conveys the bill having been inserted into the bill insertion slot, and a bill identification part which judges the validity of the bill to be conveyed (and also called authenticity judgment).

Usually, in the bill processing apparatus as described above, for example, as shown in Patent Document 1, an open/close member is installed so as to be openable and closable with respect to its frame, to form a bill traveling route through which a bill is conveyed between the surface of the frame and the rear surface of the open/close member, and conveyor members (conveyor rollers, belts, and the like) that actually convey a bill are installed so as to face the bill traveling route.

In the aforementioned configuration, a bill insertion slot into which the bill is inserted is to guide the bill to the bill traveling route. As shown in FIG. 1 of Patent Document 1, right-angled upright portions are formed on the both sides of the frame having the bill traveling route, and a plate is installed between the upright portions to be overlapped with the frame, to form the bill insertion slot and the bill traveling route between the surface of the frame and the rear surface of the plate. In such a configuration, when the bill is inserted into the bill insertion slot, the bill may get stuck in a gap between the upright portions formed on the both sides of the frame and the plate installed between the upright portions. In such a case, the bill is easily bent, and it is difficult to push the bill for insertion.

[Patent Reference 1] Japanese unexamined utility model application publication No. S63-89181

DISCLOSURE OF THE INVENTION

Problem to be Solved by the Invention

In consideration of the above, here, a paper sheet processing apparatus having an insertion slot into which a paper sheet such as a bill can be inserted easily is provided.

Means to Solve the Problem

In the present invention, a paper sheet processing apparatus comprises an open/close member which is opened and closed with respect to a frame, an insertion slot which is formed between the member and the frame such that a paper sheet can be inserted thereinto when the open/close member is closed with respect to the frame, and a frame member which is installed at the insertion slot and is integrally formed so as to have a vertical frame piece along the thickness direction of the insertion slot and a horizontal frame piece along the lateral direction of the insertion slot. Further features of the present invention, its nature, and various advantages will be more apparent from the accompanying drawings and the following description of the preferred embodiment.

DESCRIPTION OF NOTATIONS

Figure 1:
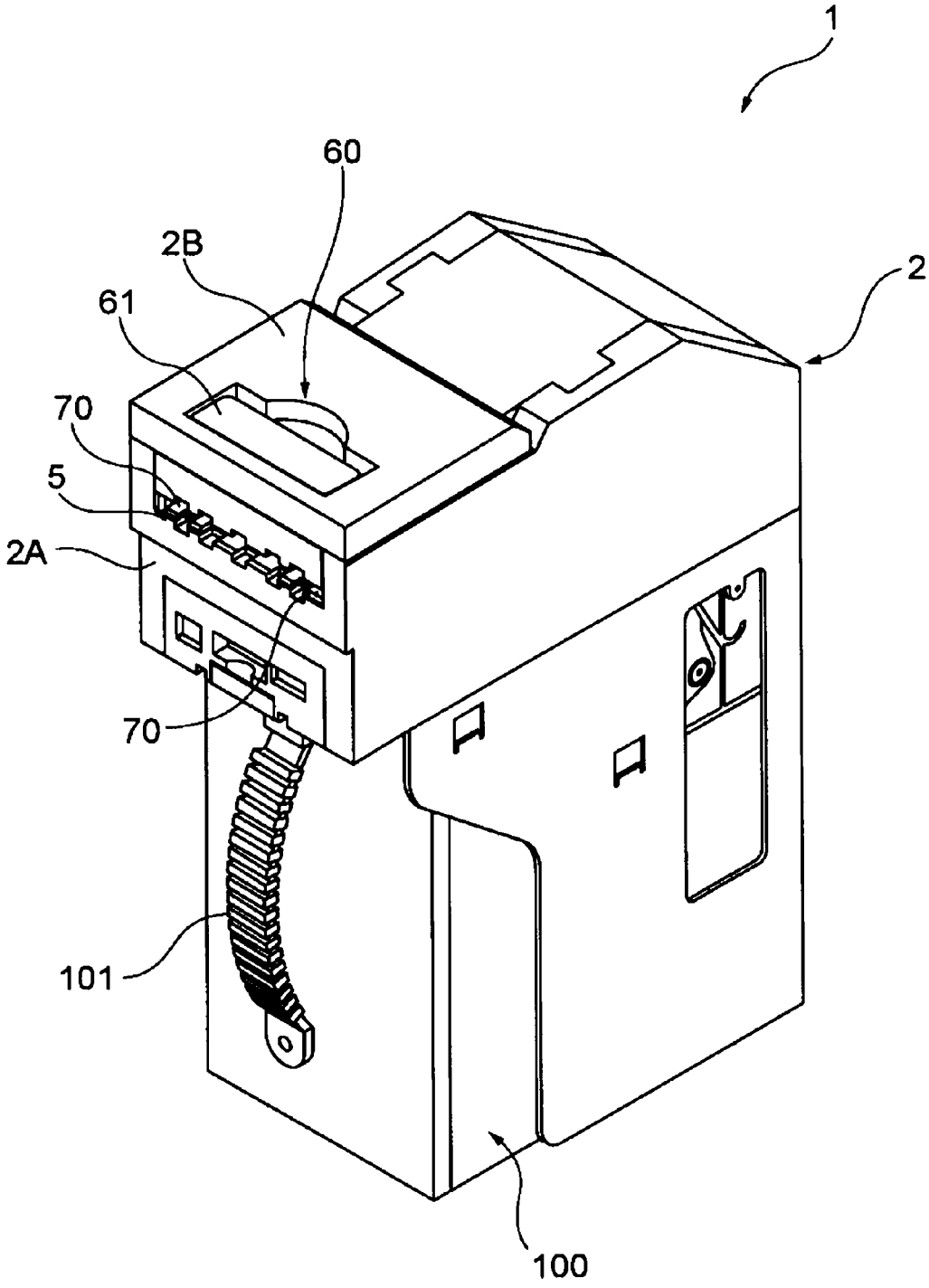
FIG. 1 is a perspective view showing an entire structure to illustrate a configuration of a bill processing apparatus.

1 bill processing apparatus
2 apparatus main body
2A frame
2B open/close member
3 bill traveling route
3A first traveling route
3B second traveling route
5 bill insertion slot
6 bill conveyance mechanism
8 bill reading means
10 skew correction mechanism
10A movable piece
10*b* ceiling plate
68 locking pin
70 frame member
71 vertical frame piece
72 horizontal frame piece
72*a* upper frame
72*b* lower frame

BEST MODE FOR CARRYING OUT THE INVENTION

Hereinafter, an embodiment of the present invention will be described with reference to the drawings.

Figure 2:
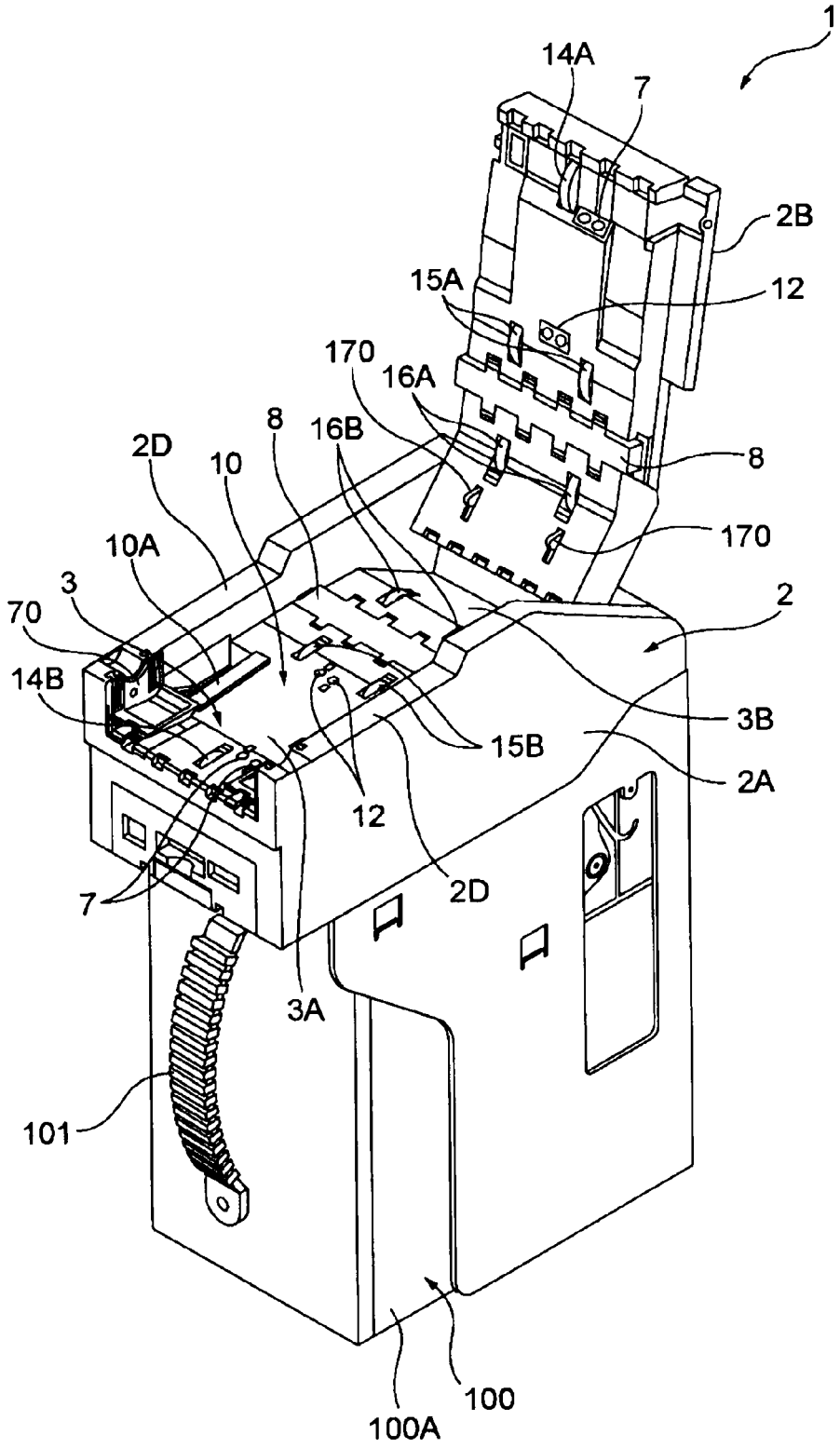
FIG. 2 is a perspective view showing the bill processing apparatus in a state that an open/close member is opened for a main body frame of an apparatus main body.
Figure 3:
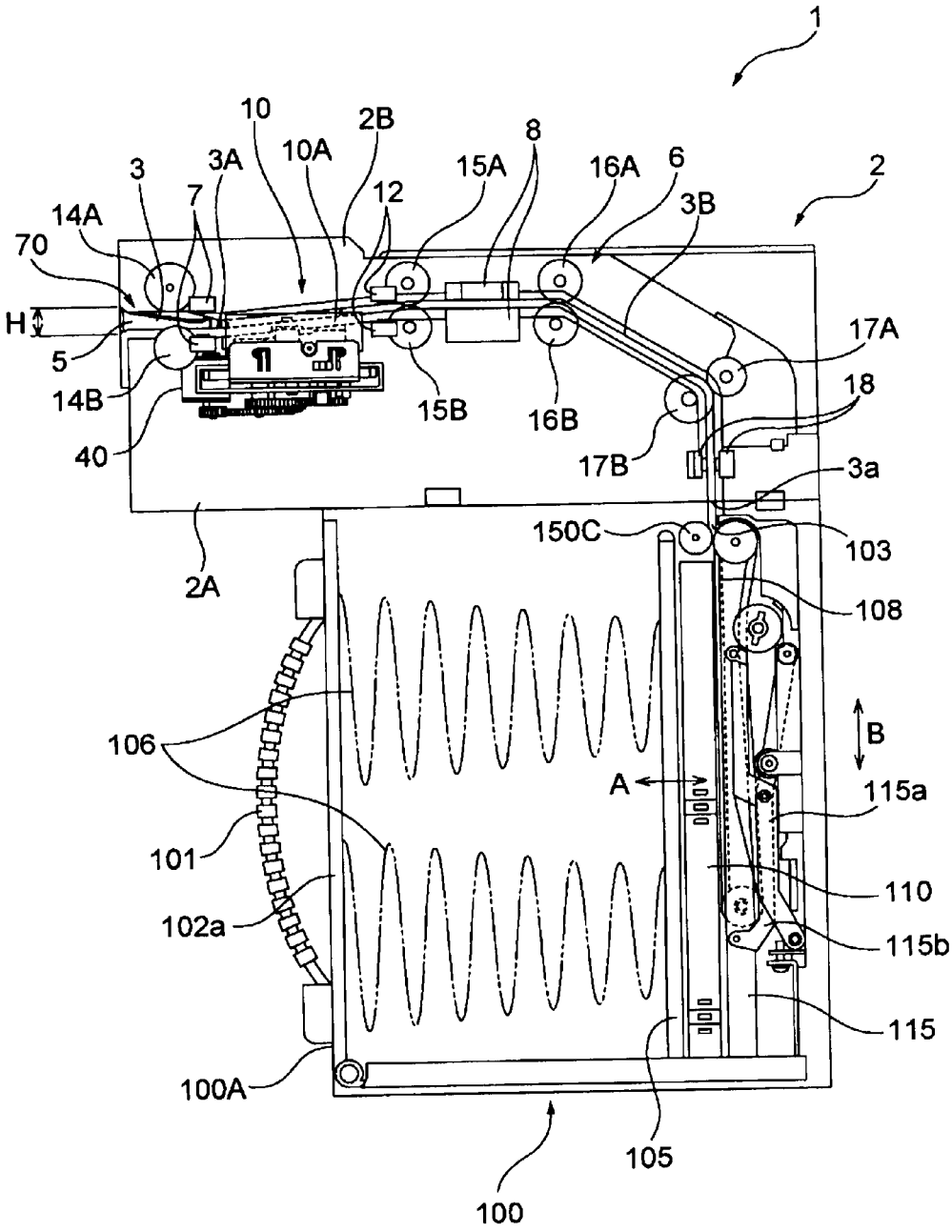
FIG. 3 is a right side view schematically showing a traveling route of a bill to be inserted from an insertion slot.
Figure 4:
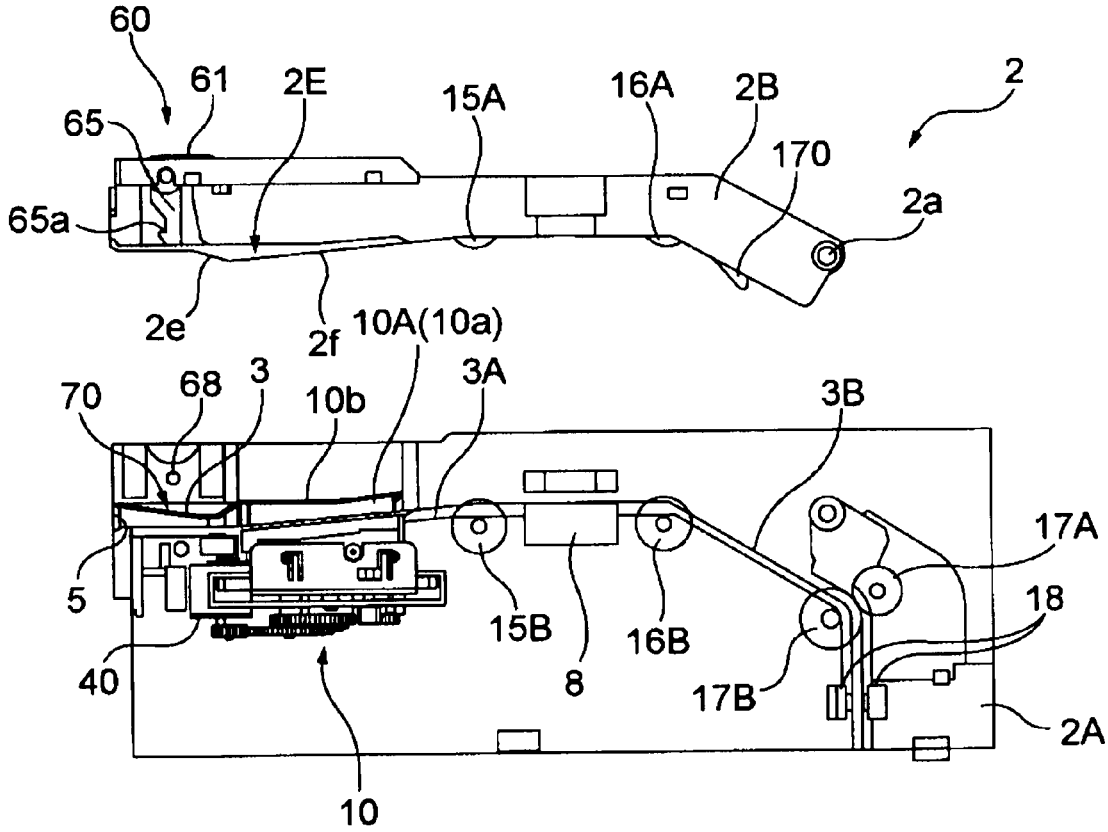
FIG. 4 is a right side view illustrating a state that an open/close member is removed from the apparatus main body.
Figure 5:
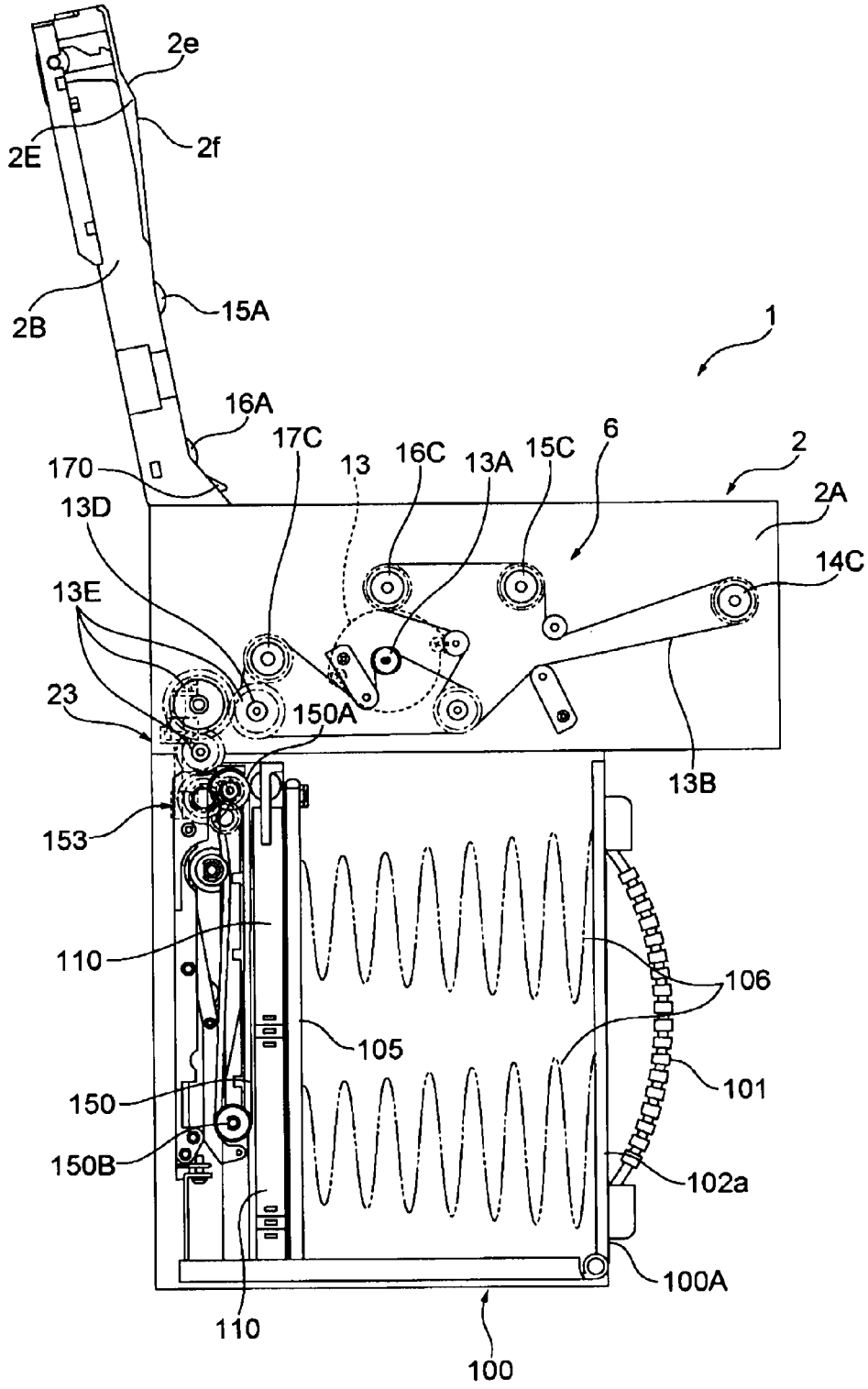
FIG. 5 is a left side view showing a schematic configuration of a driving source and a driving force transmission mechanism to drive a bill conveyance mechanism.
Figure 6:
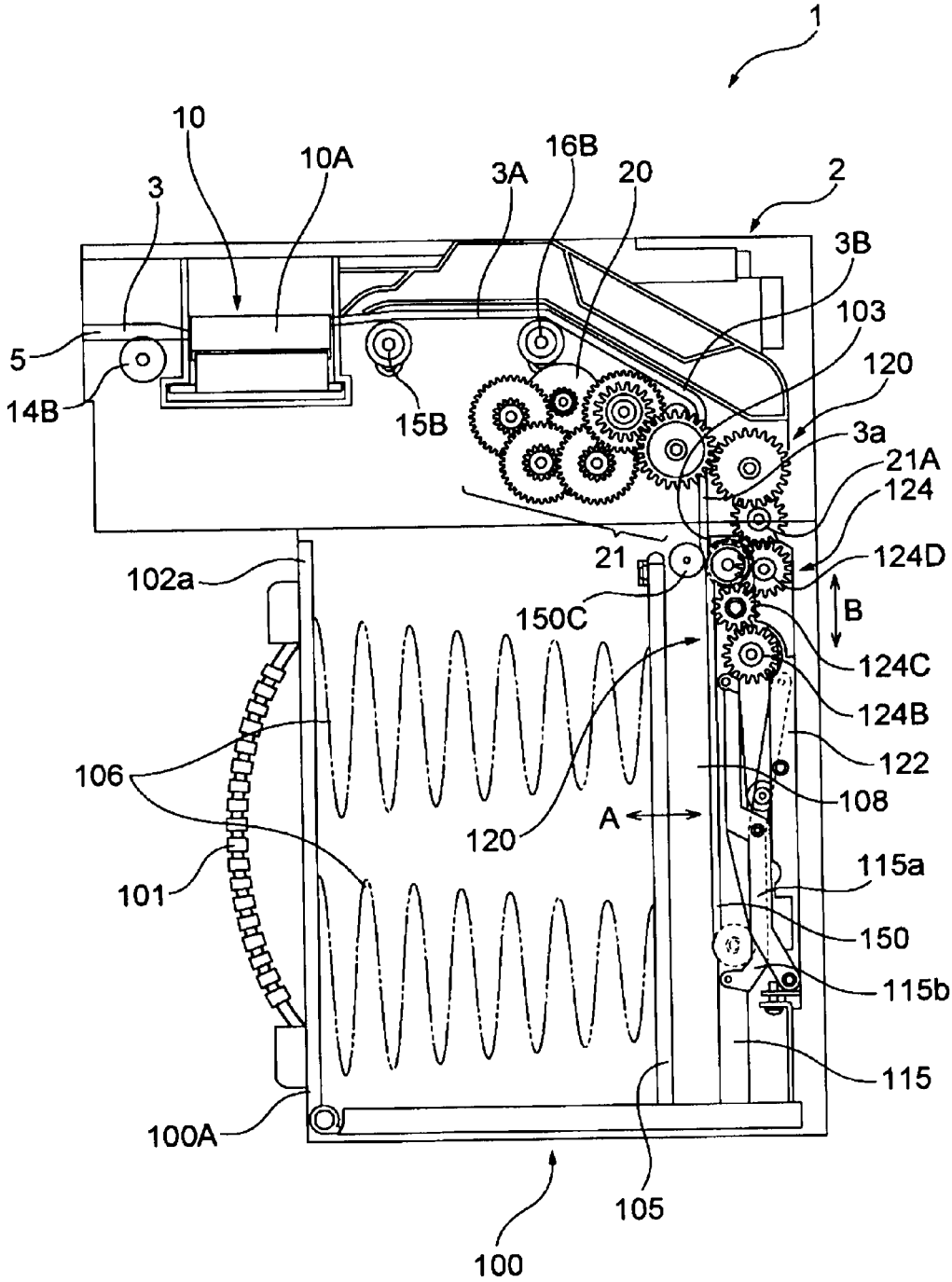
FIG. 6 is a view showing a schematic configuration of a power transmission mechanism for driving a presser plate arranged in a bill housing part.

FIGS. 1 to 6 are diagrams showing embodiments in which a paper sheet processing apparatus of the present invention is applied to a bill processing apparatus. FIG. 1 is a perspective view showing the entire structure; FIG. 2 is a perspective view showing a state that an open/close member is opened for a main body frame of an apparatus main body; FIG. 3 is a right side view showing schematically a traveling route of a bill being inserted from an insertion blot; FIG. 4 is a right side view showing a state that the open/close member is removed from the main body frame; FIG. 5 is a left side view showing a schematic structure of a driving source and a driving force transmission mechanism to drive a bill conveyance mechanism; and FIG. 6 is a diagram showing a schematic structure of a driving force transmission mechanism to drive a presser plate installed in a bill housing part.

First, an entire configuration of a bill processing apparatus will be described with reference to these drawings.

A bill processing apparatus 1 of this embodiment is so configured that it can be incorporated into, for example, various types of gaming machines such as a slot machine and the like, and the bill processing apparatus 1 includes an apparatus main body 2 and a bill housing part (bill stacker or cashbox) 100 which is provided to the apparatus main body 2 and is capable of stacking and housing a great number of bills. In this case, the bill housing part 100 may be mountable to and demountable from the apparatus main body 2, and it is possible, for example, to remove from the apparatus main body 2 by pulling a handle 101 provided on the front face thereof in a state that a lock mechanism (not shown) is unlocked.

As shown in FIGS. 2, 4, and 5, the apparatus main body 2 has a main frame body 2A and an open/close member 2B being configured to be opened and closed for the main body frame 2A by rotating around an axis positioned at one end thereof as a rotating center. The open/close member 2B is installed so as to be rotatable with respect to the main body frame 2A around a spindle 2*a* provided on the back end side.

It is configured that a lock mechanism 60, which will be described later, is installed in the front end area of the open/close member 2B, and that a operating piece 61 as one of the components thereof is so operated as to be lifted up toward the front side in FIG. 1 in order to unlock the lock mechanism 60 whereby the open/close member 2B can be opened with respect to the main body frame 2A.

Further, as shown in FIGS. 3 and 4, the main body frame 2A and the open/close member 2B are configured to form a space (bill traveling route) 3 through which a bill is conveyed such that the space is between a bottom face of the open/close member 2B and a top face of the main body frame 2A which are facing with each other when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

In the apparatus main body 2, a bill conveyance mechanism 6 that conveys a bill along a bill traveling route 3; an insertion detecting sensor 7 that detects the bill inserted into the bill insertion slot 5; bill reading means 8 that is installed on a downstream side of the insertion detecting sensor 7 and reads out information on the bill is printed in a traveling sate; a skew correction mechanism 10 that accurately positions and conveys the bill with respect to the bill reading means 8; a movable piece passage detecting sensor 12 that detects that the bill passes through a pair of movable pieces constituting the skew correction mechanism; and a discharge detecting sensor 18 that detects that the bill is discharged into a bill housing part 100 are provided.

Hereafter, the respective components described above will be described in detail. The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

Further, a shutter member 170 that prevents the bill from being conveyed toward the bill insertion slot 5 is installed in the second traveling route 3B. This shutter member 170 is rotated so as to open the second traveling route 3B when the bill moves toward the bill housing part, and is supported by the open/close member 2B so as to close the second traveling route 313 and not allow rotation when a bill housed in the bill housing part 100 is inversely drawn out.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 serving as a driving source installed in the apparatus main body 2, and conveyor roller pairs (14A and 14B), (15A and 15B), (16A and 16B), and (17A and 17B) which are installed at predetermined intervals along the bill traveling direction in the bill traveling route 3 and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

The upper conveyor roller 14A is controllably driven to be pressed against or spaced from the lower conveyor roller 14B. In particular, the upper conveyor roller 14A is spaced from the lower conveyor roller 14B so as to release the load on the bill when a process (skew correction process) for positioning the bill for the bill reading means 8 by eliminating tilt of the inserted bill is executed by the skew correction mechanism 10, and the upper conveyor roller 14A is driven to move toward the lower conveyor roller 14B again to nip and hold the bill therebetween when the skew correction process is completed. The skew correction mechanism 10 comprises a pair of right and left movable pieces 10A (only one side is shown) that perform skew correction and the skew correction process is performed by driving a motor 40 for a skew driving mechanism.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and when the detection signal is generated, the driving by the motor 13 is stopped such that the skew correction is made. The movable piece detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the second traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill conveyed in a state that the skew is eliminated by the skew correction mechanism 10 (in a state that the bill is accurately positioned), and judges the validity (authenticity) of the bill. In detail, for example, the bill reading means 8 may comprise a line sensor that performs reading of the bill such that a bill to be conveyed is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be conveyed.

The bill housing part 100 that houses bills is so configured as to be mountable to and demountable from the apparatus main body 2, and to stack and house sequentially the bills having been identified as being genuine by the bill reading means 8.

As shown in FIGS. 3, 5, and 6, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill Ml of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 3 and 6, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 6, a housing part side gear train 124 constituting the presser plate driving mechanism 120 is connected to the pinion. For this case, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 (movement toward the bill housing part 100 side, or movement toward the bill insertion slot 5 side in case the bill is not identified as authentic in the authenticity identification process) by the bill conveyance mechanism 6.

Figure 8A:
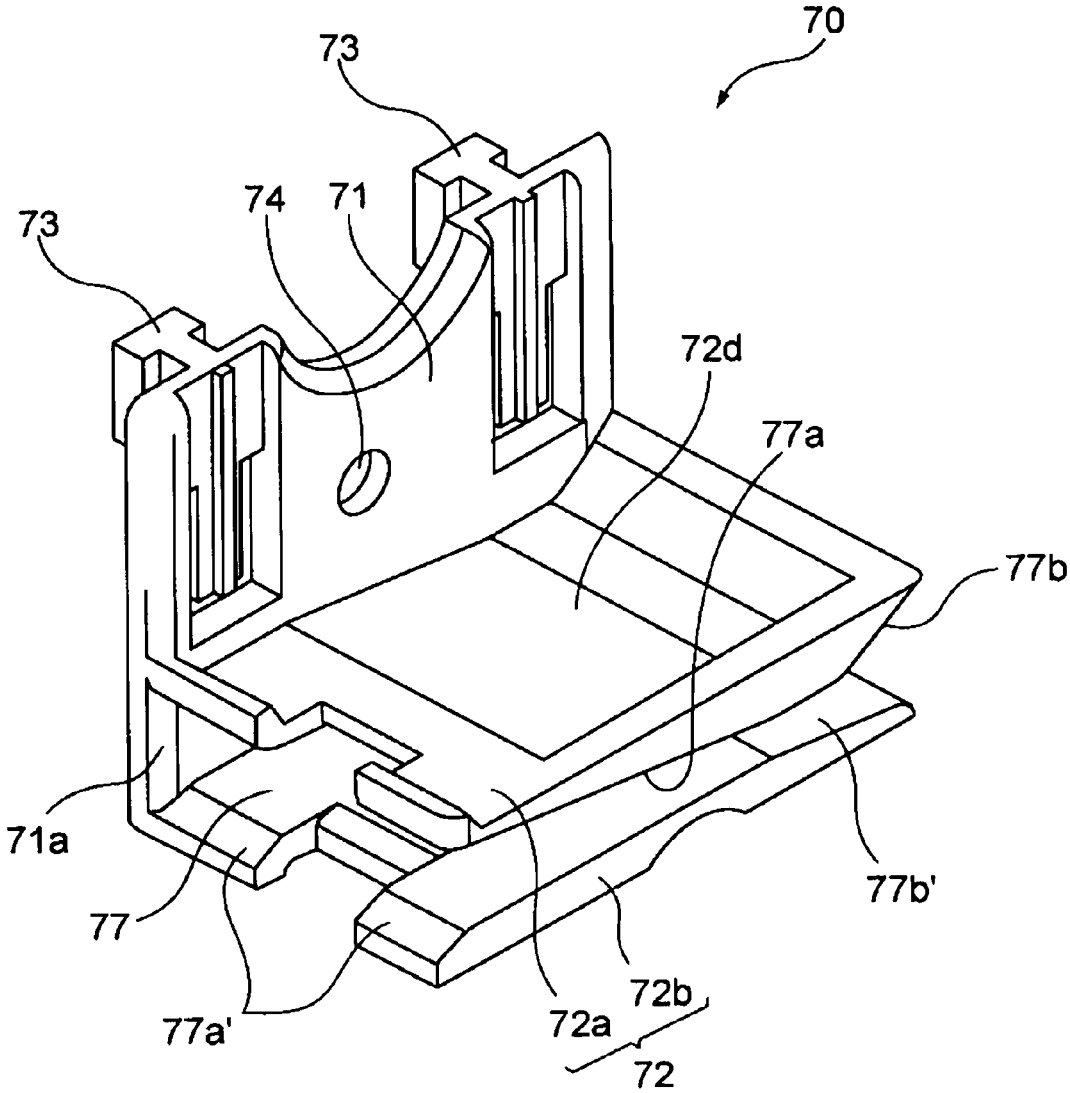
FIG. 8A is a perspective view showing a configuration of a frame member (left).
Figure 8B:
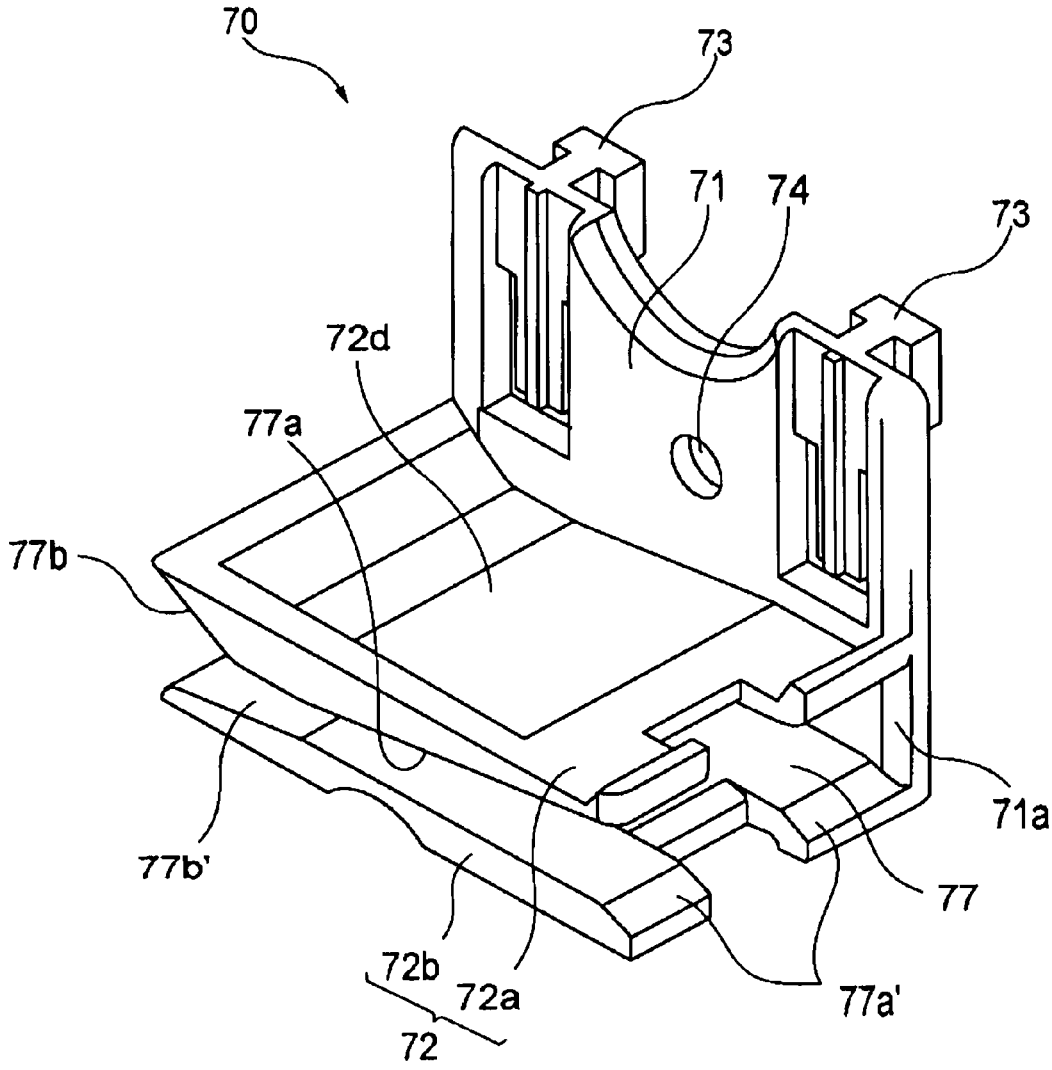
FIG. 8B is a perspective view showing a configuration of a frame member (right).
Figure 9A:
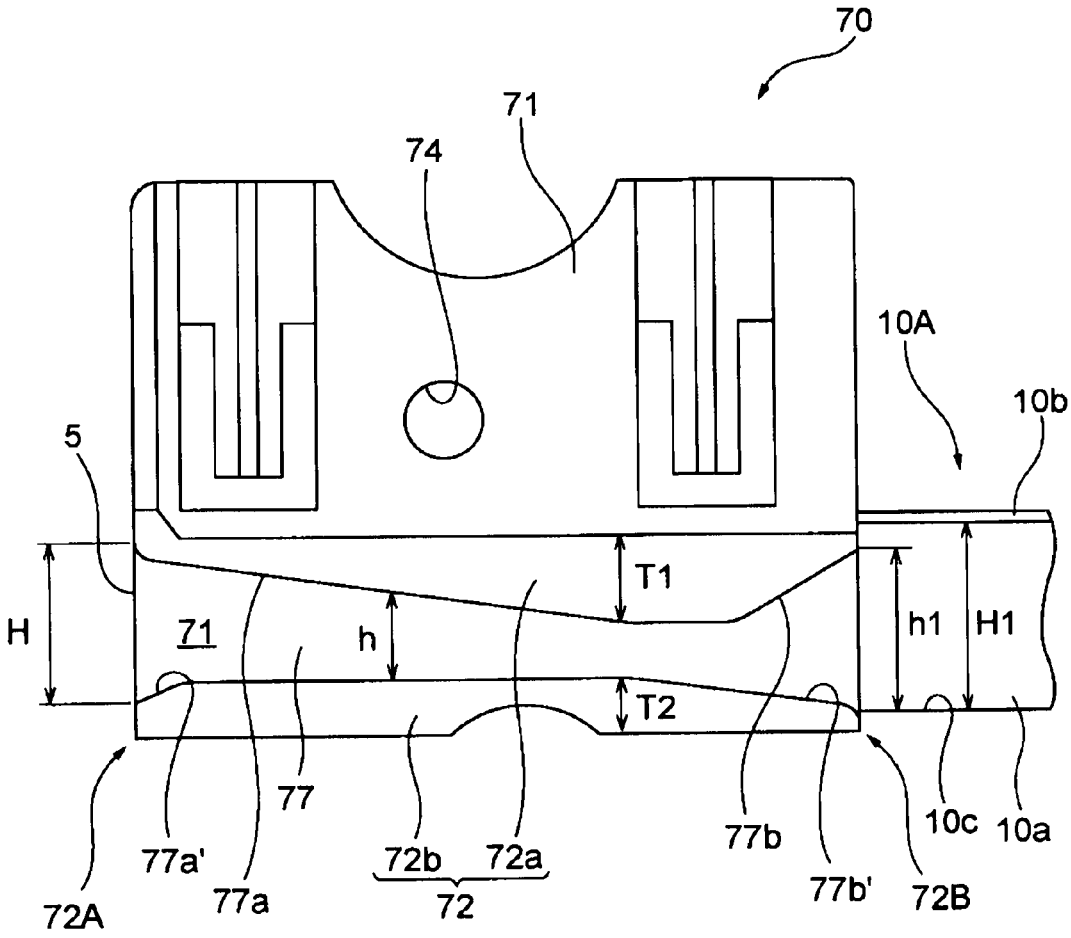
FIG. 9A is a side view showing a configuration of the frame member (left) and a relation thereof with a movable piece of a skew correction mechanism.
Figure 9B:
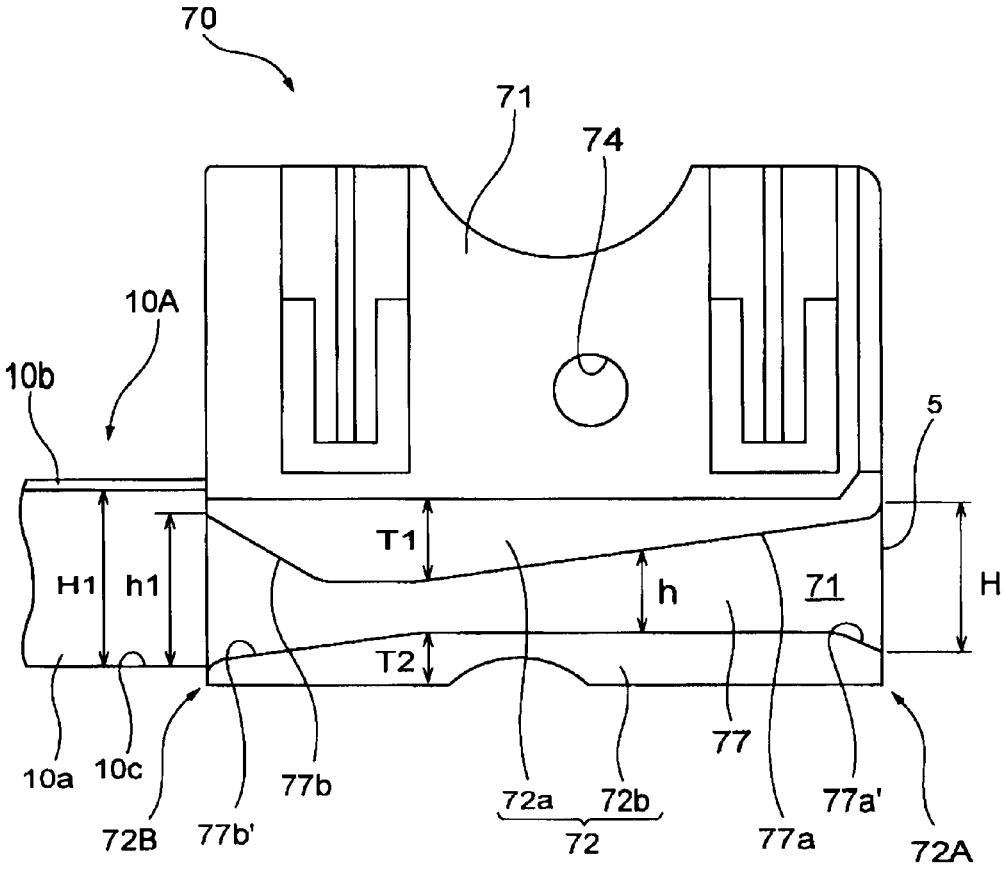
FIG. 9B is a side view showing a configuration of the frame member (right) and a relation thereof with a movable piece of a skew correction mechanism.
Figure 10:
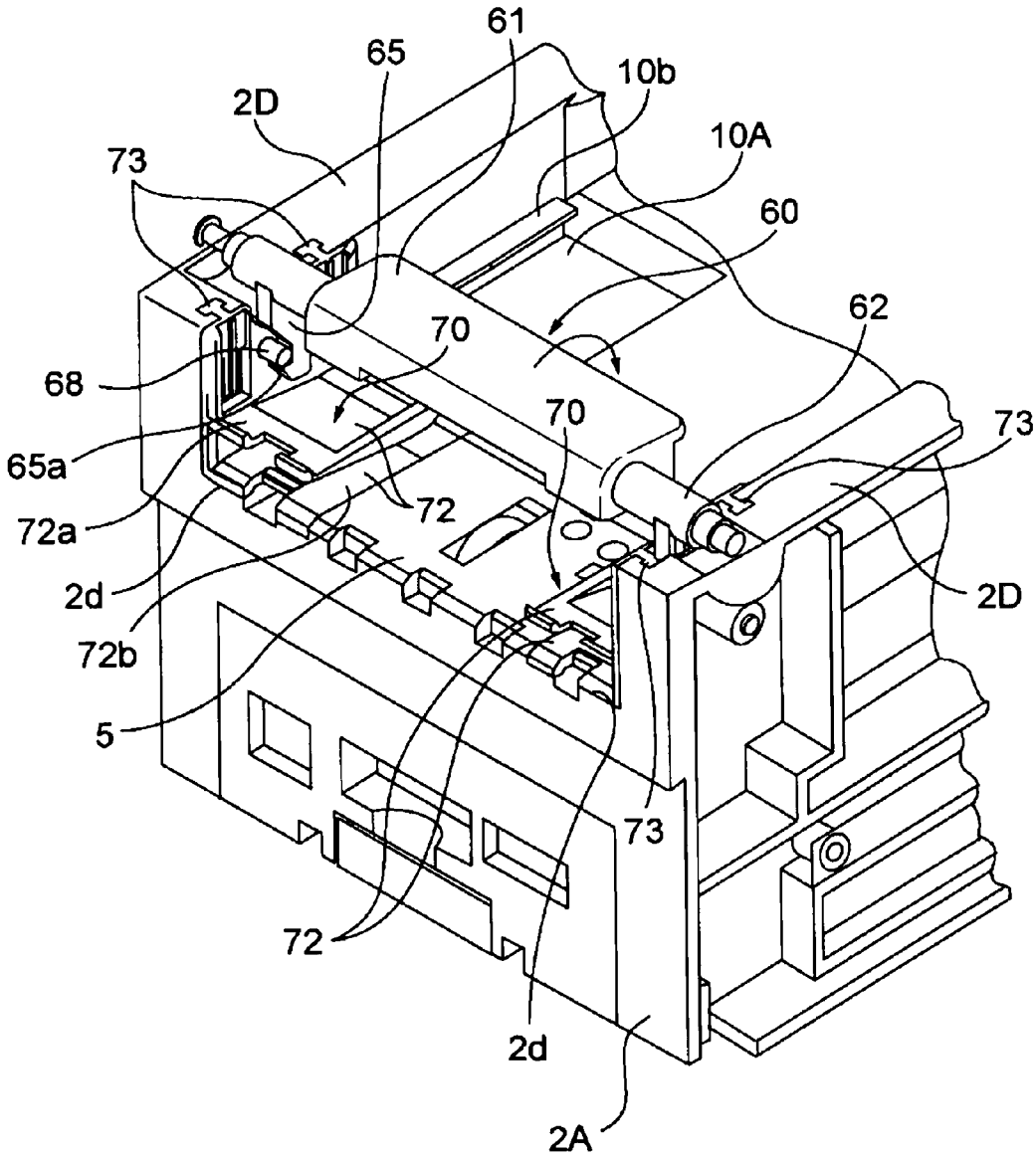
FIG. 10 is a perspective view showing a state that the frame member is installed and a configuration of a lock mechanism of the open/close member.
Figure 11:
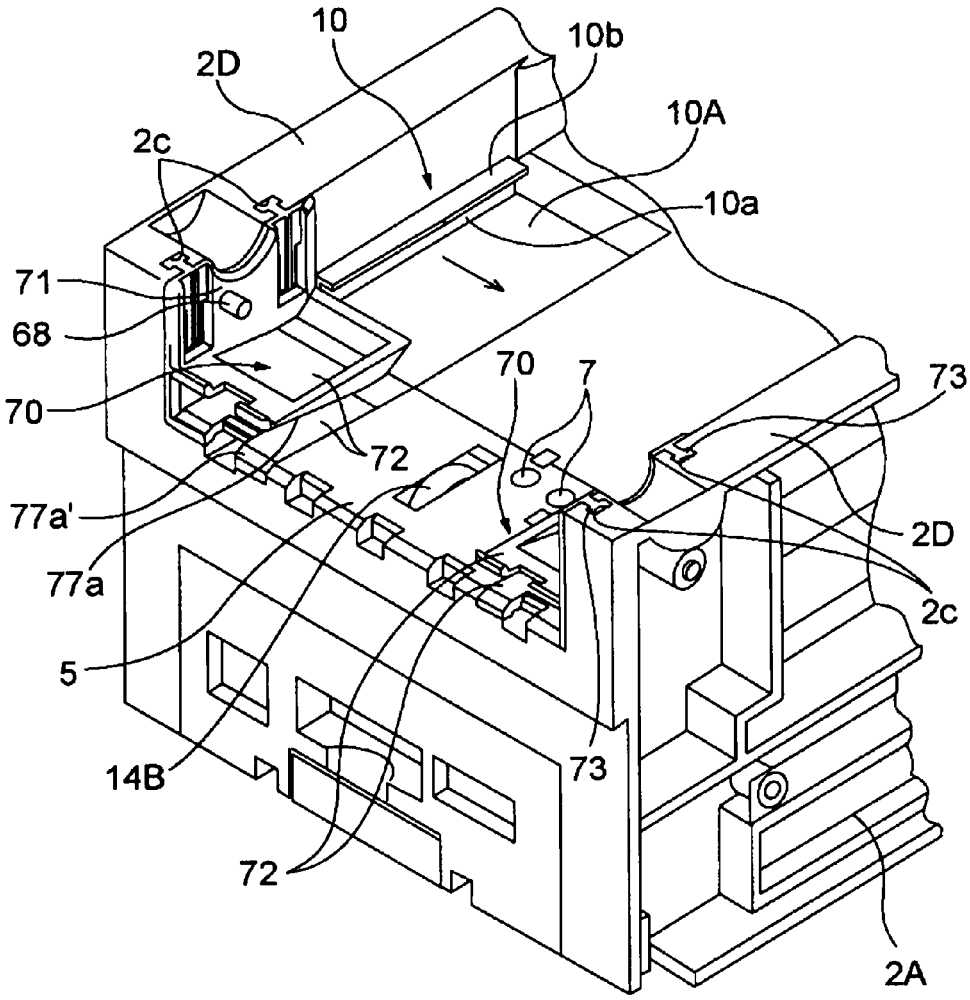
FIG. 11 is a perspective view to illustrate a relation between the frame member and the movable piece of the skew correction mechanism.

Frame members 70 are installed in the above-mentioned bill insertion slot 5 such that an insertion operation can be easily made without getting paper jammed or stuck in the insertion slot area. In the following, a configuration of the frame member 70 will be described with reference to FIGS. 7 to 11. Here, FIG. 7, among these drawings, is a perspective view to illustrate a method of installing the frame members arranged in the bill insertion slot; FIGS. 8A and 8B are perspective views showing the configurations of the right and left frame members; FIGS. 9A and 9B are side views showing the configurations of the right and left frame members, and the relationship between the right and left frame members and movable pieces of the skew correction mechanism; FIG. 10 is a perspective view showing a state that the frame members are mounted and the configuration of the lock mechanism of the open/close member; and FIG. 11 is a perspective view showing the relationship between the frame members and the movable pieces of the skew correction mechanism.

Figure 7:
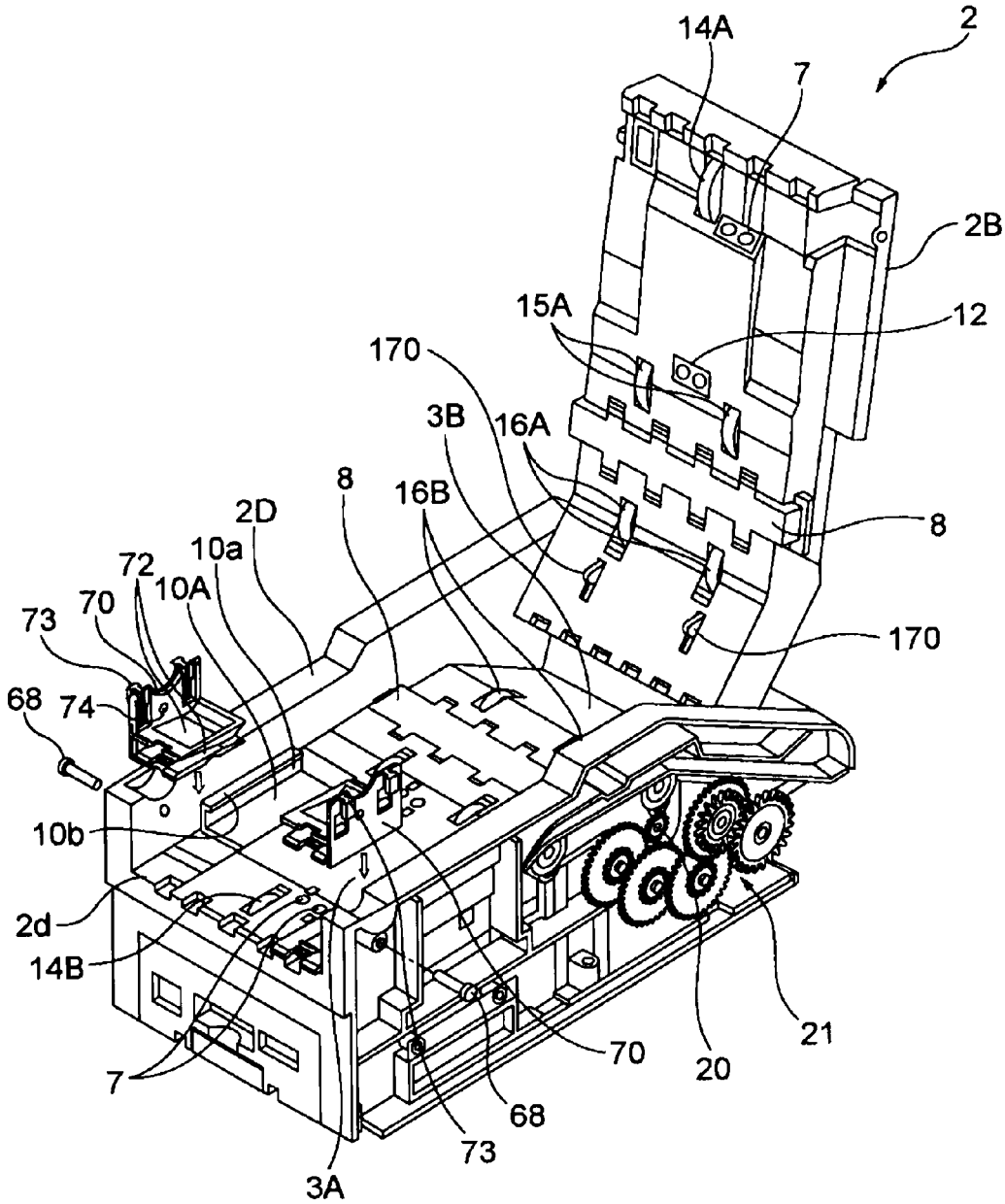
FIG. 7 is a perspective view to illustrate a method of installing a frame member to be arranged at the bill insertion slot.

The frame members 70 are installed on the both sides of the main body frame 2A, more specifically, as shown in FIG. 7, on the both sides of the bill insertion slot 5 which is formed when the open/close member 2B is closed with respect to the main body frame 2A, so that the front end edges of the frame members are aligned with the opening of the bill insertion slot as in a state of installation. Each of the right and left frame members 70 has, as shown in FIGS. 8A, 8B, 9A, and 9B, a vertical frame piece 71 so formed as to be along the thickness direction of the bill insertion slot 5, and horizontal frame pieces 72 so formed as to be along the horizontal direction (width direction) of the bill insertion slot 5 on the lower side of the vertical frame piece 71, and these are integrally formed of material such as resin or metal. Since the right and left frame members 70 respectively appear symmetrically, only the frame member 70 on the left side in FIG. 7 will be described in the following description.

A pair of engaging protrusions 73 and 73 are integrally formed along the bill conveying direction, and these engaging protrusions 73 and 73 are fit into a pair of recess portions 2*c* and 2*c* (refer to FIG. 11) formed in a side wall 2D of the main body frame 2A in a direction perpendicular to the bill conveying direction (in the direction of the arrows in FIG. 7). Further, a fixing hole 74 is formed in substantially the central area of the vertical frame piece 71. After the frame member 70 is mounted into the main body frame 2A in the direction perpendicular to the bill conveying direction by aligning the engaging protrusions 73 with the recess portions 2*c*, a fixing member (a locking pin 68) is inserted into the fixing hole 74 from the outside whereby the frame member 70 is fixed to the main body frame 2A.

In this way, because the frame member 70 is fixed in the direction perpendicular to the bill insertion direction, the frame member 70 is prevented from being shifted in the insertion direction by insertion of a bill.

In addition, the locking pin 68 used for fixing the frame member 70 to the main body frame 2A is also provided with a function as the lock mechanism 60 (refer to FIGS. 1 and 10) which may lock the open/close member 2B with respect to the main body frame 2A in this embodiment. That is, each of the locking pins 68 for fixing the frame members 70 installed on the both sides of the bill insertion slot 5 is made so long in the axial direction as to protrude inwardly from the side wall 2D of the main body frame 2A when the locking pin 68 is inserted with respect to the frame member 70. On the other hand, the lock mechanism 60 has a shaft 62 supported rotatably with respect to the open/close member 2B, and the operating piece 61 is installed in the central area of the shaft 62. This operating piece 61 is always biased so as to rotate in a direction of the arrow in FIG. 10 by a rotational biasing spring (not shown) mounted to the shaft 62 whereby locking recess portions 65*a* of locking pieces 65 provided to the shaft 62 are always biased to engage with the locking pins 68. With this configuration, when the operating piece 61 is operated to rotate in a lifting direction against the biasing force of the rotational biasing springs, the locking recess portions 65*a* of the lock pieces 65 are getting apart from the locking pins 68, so as to unlock the locked state between the open/close member 2B and the main body frame 2A, thereby enabling the open/close member 2B to open. In addition, when the open/close member 2B is closed with respect to the main body frame 2A, the locking recess portions 65*a* of the lock pieces 65 provided to the shaft 62 are engaged with the locking pins 68 according to the biasing force of rotational biasing spring such that the open/close member 2B remains in a state of being locked with the main body frame 2A.

In this way, as the locking pins 68 for fixing the frame members 70 to the main body frame 2A are provided with another function as the lock mechanism 60, the number of components may be reduced because the common components may be used for the other function such that the cost reduction may be achieved.

Further, the horizontal frame pieces 72 have predetermined lengths (lengths corresponding to side margin areas of a bill to be inserted) along the horizontal direction (width direction) of the bill insertion slot 5, and are configured to have an upper frame 72*a* and a lower frame 72*b* so as to allow a bill to be inserted therebetween. That is, a space between the upper frame 72*a* and the lower frame 72*b* constituting the horizontal frame piece 72 forms a guide channel 77 through which the bill moves, and the bill is inserted into the space surrounded by the vertical frame piece 71 and the horizontal frame pieces of the upper frame 72*a* and the lower frame 72*b*, which are integrally formed.

Accordingly, since the both sides of the bill are to be inserted into a seamless space (guide channel 77) between the vertical frame piece 71 and the horizontal frame pieces of the upper frame 72*a* and the lower frame 72*b* which are integrally formed, the side edges of the bill are prevented from getting stuck in the portion of the bill insertion slot 5 when the bill is inserted whereby it is easy to insert the bill into the bill insertion slot 5. Here, since the vertical frame piece 71, the upper frame 72*a*, and the lower frame 72*b* are integrally molded, there is no seam among them such that no side edges of the bill may get into a seam therebetween in any event. Therefore, even when the bill is pushed to be inserted from the bill insertion slot 5, the bill is allowed to smoothly move into the apparatus. Then, the boundary lines between the vertical frame piece 71, the upper frame 72*a*, and the lower frame 72*b* are preferably rounded, and preferably have predetermined R shapes for example. In this way, in order for the sides (side edges) of the bill not to get stuck in the interior surfaces of the frame members 70, liners may also be pasted on or inserted into the internal surfaces.

Further, the lower surface of the open/close member 2B is brought into face-contact with the top surface side of the upper frame 72*a* of the horizontal frame pieces 72 when the open/close member 2B is closed. In this case, the upper frame 72*a* has a predetermined wall thickness in the direction perpendicular to the bill conveying direction, and a recess place 72*d* is formed so as to face-contact with the protrusion on the lower surface of the open/close member 2B. Further, the lower frame 72*b* has a predetermined wall thickness in the direction perpendicular to the bill conveying direction, and as shown in FIGS. 7 and 10, the lower frame 72*b* is installed to be substantially flush (preferably flush) with the surface of the bill traveling route 3. Therefore, a concave place 2*d* is formed on the surface of the bill traveling route 3 of the main body frame 2A so as to allow the lower frame 72*b* to be installed therein. Then, it is more preferable that the upper surface of the lower frame 72*b* is disposed in the same height as the surface of the bill traveling route 3.

As described above, the frame member 70 has a structure in which the bill does not get stuck when the bill is inserted since the vertical frame 71 and the horizontal frame 72 are integrally formed, and when the bill is moved, as shown in FIGS. 9A and 9B, the horizontal frame 72 forms the guide channel 77 between the upper frame 72*a* and the lower frame 72*b*. In such a structure, it is preferable that height H in the bill thickness direction of the bill insertion slot 5 (the height of the opening to be exposed as a bill insertion slot; refer to FIGS. 3, 9A, and 9B) is formed to be higher than the height in the bill thickness direction of the guide channel 77 in the frame member 70 (opening height h at any position in the guide channel 77 formed by the upper frame 72*a* and the lower frame 72*b*).

That is, it is preferable that the frame member 70 is formed such that the height H forming the bill insertion slot 5 to be its opening portion has the highest height. With such a configuration, when the bill is inserted into the frame member 70, since the height of the opening defining the bill insertion slot 5 has the highest height, it is easy to insert the bill.

Further, it is preferable that the frame member 70 is made of wall gradually getting thinner as it approaches the end portions. In detail, as shown in FIGS. 9A and 9B, the upper frame 72*a* and the lower frame 72*b* of the horizontal frame piece 72 are configured such that the respective wall thicknesses T1 and T2 are made gradually thinner as they approach the end portions (front end 72A and back end 72B).

In accordance with such a shape, inclined surfaces 77*a*, 77*b*, 77*a*', and 77*b*' are formed at the respective end areas in the upper frame 72*a* and the lower frame 72*b*. When a bill passes through the frame members 70, the bill is moved along the thin-walled portions, i.e., the aforementioned inclined surfaces 77*a*, 77*b*, 77*a*', and 77*b*', thereby making the movement of the bill smooth, which makes it possible to reliably prevent the bill from getting jammed or the like. Moreover, since the bill is moved along the thin-walled portions, the end edges of the bill are not damaged in any case.

In addition, although such portions to be made thin-walled may be only on the side of the front end 72A, as described above, a bill is conveyed toward the bill insertion slot to be discharged therefrom in some cases. Therefore, as shown in the drawings, the backend 72B as well is preferably made thin-walled. Further, not only the horizontal frame pieces 72*a* and 72*b*, but also the vertical frame piece 71 is preferably made gradually thin-walled as it approaches its ends in the same way (the inclined surfaces formed by making it thin-walled in that way are shown by reference numerals 71*a* in FIGS. 8A and 8B).

As shown in FIGS. 3, 4, and 11, the pair of movable pieces 10A constituting the skew correction mechanism 10 are positioned on the downstream side of the frame members 70. The movable pieces 10A has a function that those are driven in a direction of the arrow (toward the center of the traveling route) from the opened position shown in FIG. 11, and regulatory walls 10*a* thereof come into contact with the side edges of the bill to correct its skew.

In this case, ceiling plates 10*b* are formed integrally with the regulatory walls 10*a* of the movable pieces 10A along the traveling direction, so as to cover over the side edges in the longitudinal direction of the bill to be conveyed in, that regulates uplift of the bill to be conveyed in to prevent the bill from getting jammed. Then, it is preferable that the movable piece 10A configured in this way and the frame member 70 are, as shown in FIGS. 9A and 9B, formed into the relationship in which height (height at the back end 72B) hi of the discharge portion in the guide channel 77 is lower than height H1 in the bill thickness direction formed by a surface 10*c* and the ceiling plate 10*b* of the movable piece 10A. Further, it is preferable that the lower face (surface of the lower frame 72*b*) of the discharge portion of the guide channel 77 is arranged at the same height as the surface 10*c* of the movable piece 10A. And, it is preferable that the upper face (lower face of the upper frame 72*b*) of the discharge portion of the guide channel 77 is arranged at the same height (or lower than) as the surface 10*c* of the movable piece 10A.

With the configuration in this way, it is possible to reliably guide the bill between the ceiling plates 10*b* and the surfaces 10*c* of the movable pieces 10A for skew correction from the guide channel 77 of the frame members 70.

In addition, in the present embodiment, as described above, since the upper frame 72*a* and the lower frame 72*b* of the horizontal frame piece 72 are configured to make the wall thicknesses gradually thin-walled as they approach the end (the front end 72A), the height of the guide channel 77 is formed so as to be gradually lower toward the bill conveying direction when viewed from the insertion slot side as shown in FIGS. 9A and 9B (the inclined surfaces 77*a* and 77*a*' which become gradually lower in height along the bill thickness direction). Further, even when viewed from the side of the skew correction mechanism, in the same way, the inclined surfaces 77*b* and 77*b*' along which the height of the guide channel become gradually lower in height are formed. At this time, the opening height h of the guide channel 77 becomes gradually lower at a predetermined ratio (a lowering rate) inwardly from the bill insertion slot 5, to be the minimum height, and inversely becomes gradually higher at a predetermined ratio (an enlarging rate). Then, the enlarging rate is preferably greater than the lowering rate.

With such a configuration, the bill inserted from the bill insertion slot 5 is guided so as to be gradually pressed down in the guide channel 77 of the frame members 70, and is thereafter guided to the movable pieces 10A. Therefore, the bill does not touch the portions of the ceiling plates 10*b* of the movable pieces 10A in any case, which makes it possible to more reliably guide the bill to the movable pieces 10A.

Here, as shown in FIGS. 4 and 5 in this embodiment, a raised portion 2E with an inclined slope profile is formed on the rear surface of the open/close member 2B so as to get into a space between the respective ceiling plates 10*b* of the pair of movable pieces 10A when the open/close member 2B is closed with respect to the main body frame 2A. The raised portion 2E is formed with a first inclined guide face 2*e* gradually coming down as it goes in the insertion direction of the bill, and a second inclined guide face 2*f* gradually coming down as it goes in the discharging direction of the bill, and effectively prevents the bill from being moving up when the bill moves in an area of the skew correction mechanism.

That is, when the bill moves toward the inside of the apparatus, the bill is reliably pressed down by the inclined surfaces 77*a* and 77*a*' of the frame members 70 described above, the first inclined guide surface 2*e*, and the respective ceiling plates 10*b* of the right and left movable pieces 10A as well, thereby preventing uplift thereof. Further, in a similar way, when the bill is conveyed toward the bill insertion slot 5 for discharge, the bill is also reliably pressed down by the inclined surfaces 77*b* and 77*b*' of the frame members 70 described above, the first inclined guide surface 2*e*, and the respective ceiling plates 10*b* of the right and left movable pieces 10A as well whereby the uplift of the bill is prevented.

In this way, by mounting the frame members 70 having the aforementioned configuration, when the bill is conveyed from the bill insertion slot 5 toward the skew correction mechanism 10, and when the bill is conveyed from skew correction mechanism 10 toward the bill insertion slot 5, a possibility that the bill gets stuck is decreased such that it becomes possible to reliably prevent the bill from getting jammed or the like.

As mentioned above, the embodiment of the present invention is described. However, the present invention is not limited to the above-described embodiments, and various modifications of the present invention can be implemented. The above-described frame members 70 may be configured to be fixed to the both sides of the bill insertion slot 5, as is irrelevant to the lock mechanism 60, by adhesion in advance. Further, as long as the frame members 70 are configured at least to be capable of guiding the periphery of the side edge areas of a bill to be inserted (the top surfaces, the lower surfaces, and the longitudinal side edges of the sides of the bill) with a same member which is entirely formed integrally without any gap, the shape of the bill guide channel 77, the method for mounting it to the main body frame 2A, and the like may be appropriately modified.

In accordance with the paper sheet processing apparatus of the aforementioned embodiment, it is possible not to generate a gap between the frame and the open/close member with the frame members installed at the insertion slot, and the paper sheet or the like is prevented from getting stuck in the insertion slot when a paper sheet or the like is inserted, which makes it easy to insert the paper sheet or the like into the insertion slot.

Also, the frame member can be fixed in a direction perpendicular to the paper sheet insertion direction.

With such a structure, since the frame members are fixed in the direction perpendicular to the insertion direction of a paper sheet or the like, the frame members are prevented from being shifted in the insertion direction due to the insertion of the paper sheet or the like.

Further, it is preferable that the frame member 70 is made gradually thin-walled as it approaches its ends.

With such a configuration, when a paper sheet passes through the frame members, it can be possible to guide the paper sheet smoothly since the paper sheet moves in the portions to be made thin-walled.

Further, the frame members have a guide channel for guiding a paper sheet to be inserted from the insertion slot toward the downstream side, and the height in the thickness direction of a paper sheet of the insertion slot can be formed to be higher than the height in the thickness direction of a paper sheet of the guide channel.

With such a configuration, when a paper sheet is guided to the frame members, it is easy to insert the paper sheet into the insertion slot since the height in the thickness direction of a paper sheet of the insertion slot is set to be higher.

Further, the ceiling plates for preventing uplift of a paper sheet or the like are formed on the downstream side of the guide channel, and the movable pieces for skew correction for correcting a tilt in the conveying direction of the paper sheet or the like are installed, and the height in the thickness direction of a paper sheet or the like in the guide channel can be formed to be lower than the height in the thickness direction of a paper sheet or the like in the traveling route for paper sheets or the like formed by the surfaces and the ceiling plates of the movable pieces.

With such a configuration, since the height of the guide channel of the frame members is set to be lower than the height of the traveling route for paper sheets or the like in the movable pieces for skew correction, it is possible to reliably guide a paper sheet or the like between the ceiling plates and the surfaces of the movable pieces for skew correction from the guide channel of the frame members.

Further, the height in the thickness direction of a paper sheet or the like of the guide channel may be formed to be gradually lower toward the bill conveying direction.

With such a configuration, the paper sheet is guided so as to be gradually pressed down in the guide channel of the frame members, and is thereafter guided to the movable pieces. Therefore, the paper sheet does not touch the portions of the ceiling plates of the movable pieces in any case whereby it is possible to more reliably guide the paper sheet to the movable pieces. Further, the paper sheet processing apparatus in which a paper sheet or the like is taken and conveyed along the traveling route preferably comprises: a frame capable of forming a bottom face of the traveling route along the bottom face of the paper sheet or the like, an open/close member capable of forming a top face of the traveling route along the top face of the paper sheet or the like, a frame member which is disposed on the inner side of at least one side face of the insertion slot into which the paper sheet or the like is inserted, the insertion slot is formed by the frame and the open/close member. At this time, the frame member is opened with respect to the inner side of the insertion slot so as to allow the corresponding side edge of the paper sheet or the like to get into. Then, it is possible to provide a paper sheet processing apparatus in which the frame member is configured such that the surfaces of a vertical frame piece along the side face, and a horizontal frame piece constituted of an upper frame and a lower frame along the width direction of the traveling route are at least continuously connected. This frame member may form a guide channel which is defined by the upper frame and the lower frame, which guides the paper sheet or the like to be inserted from the insertion slot to the downstream side. The opening height of the guide channel may be made lower at a predetermined lowering rate as it approaches inward (the back) from the insertion slot, to be the minimum height, and may be thereafter enlarged at an enlarging rate greater than the lowering rate. The surface of the lower frame may be disposed at a height which is the same as the lower surface of the traveling route. Further, a movable piece may be disposed on the downstream side of the guide channel so as to correct a tilt to the conveying direction of the paper sheet or the like. Such a movable piece may have a surface on which the paper sheet or the like can be placed, a regulatory wall for skew correction which is disposed so as to be movable to a position wider than the vertical frame piece, and a ceiling plate overhanging inward from the upper portion of the regulatory wall. Then, the surface of the lower frame constituting the guide channel may be provided at a height which is the same as the surface of the movable piece. The bottom face of the upper frame defining the guide channel may be provided at a height which is the same as or lower than the bottom face of the ceiling plate.

As described above, the paper sheet processing apparatus having the insertion slot through which the paper sheet such as a bill can be easily inserted can be provided.

The present invention may be incorporated into not only the above-described embodiments of bill processing apparatuses, but also various types of apparatuses providing products or services by inserting a paper sheet such as a bill and a coupon ticket.

What is claimed is:

1. A paper sheet processing apparatus comprising:

an open and close member to be opened and closed with respect to a frame;

an insertion slot formed between the open and close member and the frame such that a paper sheet can be inserted therebetween when the open and close member is closed with respect to the frame; and a frame member installed within the insertion slot and configured by integrally forming a vertical frame piece along a thickness direction of the insertion slot, and an upper frame and a lower frame along a lateral direction of the insertion slot, wherein:

the frame member comprises: a guide channel defined by the upper frame, the vertical frame piece, and the lower frame to guide downstream the paper sheet inserted from the insertion slot, the upper frame getting thinner toward both end portions along a traveling direction such that a height of the guide channel becomes lowest in a middle of the guide channel along the traveling direction, a front end edge of the frame member is aligned with an opening of the insertion slot, and a height of the insertion slot in a thickness direction of the paper sheet at the opening is higher than the height of the guide channel in the thickness direction of the paper sheet at the front end edge.

2. The paper sheet processing apparatus according to claim 1, wherein:

a ceiling plate to prevent the paper sheet from being lifted up is formed, a movable piece for skew correction to correct inclination of the paper sheet to a traveling direction is arranged on a downstream side of the guide channel, and the height of the guide channel in the thickness direction of the paper sheet is lower than a height of a paper sheet traveling route formed between the ceiling plate and a surface of the movable piece in the thickness direction of the paper sheet.

3. A paper sheet processing apparatus which takes and conveys a paper sheet along a traveling route, comprising:

a frame capable of forming a bottom face of the traveling route to face a bottom face of the paper sheet;

an open and close member capable of forming a top face of the traveling route to face a top face of the paper sheet;

a frame member arranged on an inner side of at least either side face of an insertion slot which is formed with the frame and the open and close member, and into which the paper sheet is inserted, the frame member forming a guide channel defined by the upper frame and the lower frame so as to guide downstream the paper sheet inserted from the insertion slot; and a movable piece arranged on a downstream side of the guide channel so as to correct inclination of a traveling direction of the paper sheet conveyed, wherein:

a surface of the lower frame is arranged in a same height as the bottom face of the traveling route, the movable piece comprises a surface capable of placing the paper sheet thereon, a regulatory wall for skew correction arranged movably in a wider position than the vertical frame piece, and a ceiling plate extending inwardly from an upper part of the regulatory wall, the frame member is configured to have an opening inside the insertion slot such that corresponding side edges of the paper sheet are capable of entering the opening, and to have a vertical frame piece along the side face and horizontal frame pieces including an upper frame and a lower frame along a width direction of the traveling route, a surface of which is at least continuously connected, the surface of the lower frame defining the guide channel is arranged in a same height as the surface of the movable piece, and the bottom face of the upper frame defining the guide channel is arranged in a same height as or lower height than a bottom face of the ceiling plate.

4. A paper sheet processing apparatus comprising:

an open and close member to be opened and closed with respect to a frame;

an insertion slot formed between the open and close member and the frame such that a paper sheet can be inserted therebetween when the open and close member is closed with respect to the frame; and a frame member installed within the insertion slot and configured by integrally forming a vertical frame piece along a thickness direction of the insertion slot, and an upper frame and a lower frame along a lateral direction of the insertion slot, wherein:

the frame member comprises: a guide channel defined by the upper frame, the vertical frame piece, and the lower frame to guide downstream the paper sheet inserted from the insertion slot, the upper frame getting thinner toward both end portions along a traveling direction such that a height of the guide channel becomes lowest in a middle of the guide channel along the traveling direction, the frame member is fixed in a direction perpendicular to an insertion direction of the paper sheet, a front end edge of the frame member is aligned with an opening of the insertion slot, and a height of the insertion slot in a thickness direction of the paper sheet at the opening is higher than the height of the guide channel in the thickness direction of the paper sheet at the front end edge.

* * * * *